US009957979B2

(12) United States Patent
Key

(10) Patent No.: US 9,957,979 B2
(45) Date of Patent: May 1, 2018

(54) IMPELLER REMOVAL AND INSTALLATION

(71) Applicant: Michael Key, Dayton, TX (US)

(72) Inventor: Michael Key, Dayton, TX (US)

( * ) Notice: Subject to any disclaimer, the term of this patent is extended or adjusted under 35 U.S.C. 154(b) by 367 days.

(21) Appl. No.: 14/798,386

(22) Filed: Jul. 13, 2015

(65) Prior Publication Data

US 2016/0010660 A1 Jan. 14, 2016

Related U.S. Application Data

(60) Provisional application No. 62/024,177, filed on Jul. 14, 2014.

(51) Int. Cl.
*F04D 29/20* (2006.01)
*F04D 29/62* (2006.01)

(52) U.S. Cl.
CPC ..... *F04D 29/628* (2013.01); *F04D 29/20* (2013.01)

(58) Field of Classification Search
CPC ..... F04D 29/628; F04D 29/20
See application file for complete search history.

(56) References Cited

U.S. PATENT DOCUMENTS 4,934,037 A * 6/1990 Schuerg ..... B25B 5/14 269/287
6,185,817 B1 * 2/2001 Sims ..... B25B 27/023 29/256
7,000,505 B2 * 2/2006 Hsien ..... B25B 13/065 81/121.1
8,505,417 B2 * 8/2013 Hui ..... B25B 13/06 81/121.1

* cited by examiner

*Primary Examiner* — Richard Chang
(74) *Attorney, Agent, or Firm* — The Compton Law Firm, P.C.; Scott D. Compton

(57) ABSTRACT

The application is directed to non-destructive manipulation, removal and installation of a centrifugal pump impeller in a manner effective to maintain the original manufacture balanced condition of the impeller and other pump components. Tools are used at the drive end and the wet end of the centrifugal pump for manipulating, removal and installation of a pump impeller.

19 Claims, 8 Drawing Sheets

IMPELLER REMOVAL AND INSTALLATION

CROSS-REFERENCE TO RELATED APPLICATIONS

This non-provisional patent application claims the benefit of and priority from U.S. provisional patent application No. 62/024,177 filed Jul. 14, 2014.

STATEMENT REGARDING FEDERALLY SPONSORED RESEARCH OR DEVELOPMENT

Not applicable.

FIELD OF THE APPLICATION

The application relates generally to the removal and installation of impellers for use with pump drive shafts.

BACKGROUND

Impellers such as centrifugal pump impellers are designed to accelerate fluid inside of a pump, e.g., to push fluid radially. Typical pump impellers are mechanically balanced flat circular disc type objects having a centralized drive shaft bore for accepting a drive shaft and vanes or blades on the surface arranged radially or in a sloping pattern. The centralized drive shaft bore of impellers are typically threaded for connecting to a threaded drive shaft of a pump. Because impellers are usually tightly secured to drive shafts, persons often rely on many different types of tools or other instruments to assist in removing and installing impellers by manipulating both the impeller and drive shaft at opposing ends of a pump. Unfortunately, tools and instruments currently employed often damage the drive shaft and/or the impeller resulting in unbalanced impeller rotation and pump vibration causing premature failure of pump components. In practice, damaged impellers are often refurbished by grinding down parts of the impeller to reestablish a balanced impeller for future use. However, grinding can limit the workable life of an impeller.

Non-destructive techniques for removing and installing impellers such as pump impellers is desired.

SUMMARY

The present application is directed to a system for acting on a wet end and a drive end of a pump shaft to promote engagement and disengagement of a vaned pump impeller to and from the pump drive shaft, the system including (1) a first tool member operationally configured to communicate with the drive end of the drive shaft; and (2) a second tool member for communicating with a vaned pump impeller attachable at the wet end of the pump drive shaft, the second member being operationally configured to distribute torque substantially evenly across the surface of a pump impeller during engagement and disengagement of the pump impeller.

The present application is also directed to a tool set for the assembly and disassembly of a pump including (1) a first tool member releasably attachable to a drive end of a drive shaft of the pump, the first member being operationally configured to act on the drive shaft; and (2) a second tool member operationally configured to engage a vaned impeller of the pump in a manner effective to distribute torque substantially evenly across the impeller.

The present application is also directed to a method of altering the engagement position of a vaned centrifugal pump impeller in relation to a pump drive shaft, including (1) providing a tool set including (A) a first tool member operationally configured to communicate with a drive end of the drive shaft; and (B) a second tool member for communicating with a vaned pump impeller attachable at a wet end of the drive shaft, the second member being operationally configured to distribute torque substantially evenly across the surface of a pump impeller during manipulation, engagement and disengagement of the pump impeller; (2) with the impeller of the centrifugal pump in an exposed position and in communication with the drive shaft at a first engagement position, mating a first tool member with the drive end of the drive shaft and mating a second tool member with the impeller; and (3) with the first and second tool members set at fixed mated positions, manipulating the first tool member in a manner effective to turn the drive shaft and alter the engagement position of the second mating tool from said first engagement position.

DETAILED DESCRIPTION

Figure 1:
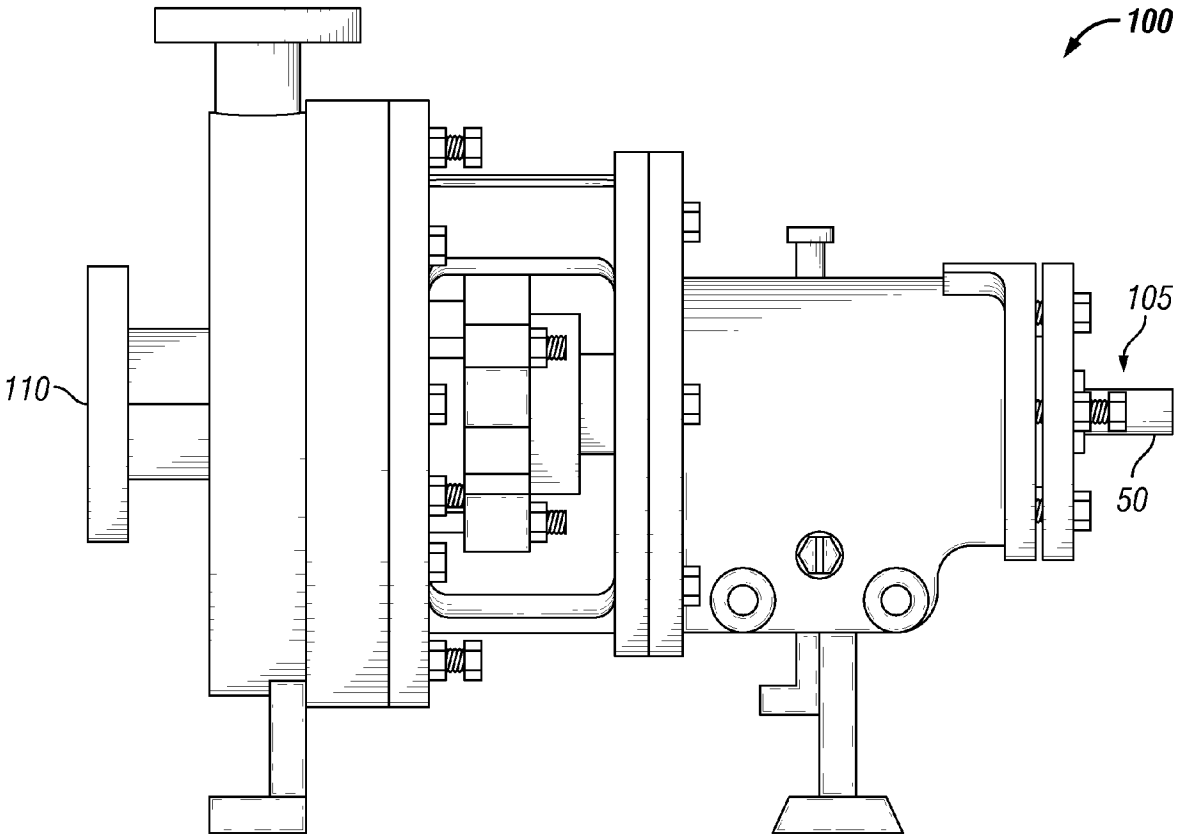
FIG. 1 is a simplified view of an exemplary centrifugal pump.

A novel approach has been discovered for removing and installing centrifugal pump impellers in a manner effective for maintaining the original manufacture balanced condition of the impeller. Heretofore, such a desirable achievement has not been considered possible, and accordingly, the teaching of this application measure up to the dignity of patentability and therefore represent a patentable concept.

Before describing the invention in detail, it is to be understood that the present invention is not limited to particular embodiments. It is also to be understood that the terminology used herein is for the purpose of describing particular embodiments only, and is not intended to be limiting. As used in this specification, the term "non-destructive" refers to the ability to (a) not affect the serviceability of (1) an impeller body that is removed and/or attached to/from a pump drive shaft and/or (2) a drive end of a drive shaft and/or (b) not affect the mechanically balanced state of an impeller from its original state or condition.

In one aspect, the application provides devices operationally configured to assist with (1) the removal of pump impellers from pump drive shafts and/or (2) the reattachment of pump impellers to pump drive shafts.

In another aspect, the application provides instruments or tools operationally configured for use with impellers having an even number of vanes and/or impellers having an odd number of vanes as desired.

In another aspect, the application provides a system for removing and installing an impeller to a pump drive shaft by controlling opposing ends of the drive shaft simultaneously during impeller removal and installation.

In another aspect, the application provides a system including one or more devices operationally configured to communicate with the drive end of a pump drive shaft and one or more devices operationally configured to communicate with one or more impellers communicable with the wet end of a pump drive shaft.

In another aspect, the application provides a tool set operationally configured to assist with (1) the removal of pump impellers from pump drive shafts and/or (2) the reattachment of pump impellers to pump drive shafts.

In another aspect, the application provides devices, systems and methods operationally configured for use with various size pumps and pump component parts.

In another aspect, the application provides an individualized method for removing an impeller from a drive shaft of a pump regardless of whether an individual performing the operation is predominantly right-handed or left-handed.

In another aspect, the application provides devices operationally configured to assist with the removal of pump impellers from pump drive shafts and/or the installation of pump impellers to pump drive shafts, including devices that are configured for storage in commercially available containers and various spaces including, but not necessarily limited to tool boxes, pick-up truck tool boxes, closets, cabinets, carrying cases, back-packs, duffle bags, glove compartments, vehicle trunks, behind a driver's seat in a single cab pick-up truck, and combinations thereof.

In another aspect, the application provides instruments, systems and methods for removing and installing repaired pump impellers in a manner effective for maintaining the current repair state of the impeller.

Discussion

To better understand the novelty of this application, reference is hereafter made to the accompanying drawings. As an introduction, an exemplary commercially available centrifugal pump 100 is provided in FIG. 1. As shown, a common centrifugal pump 100 is typically characterized by a cylindrical drive shaft 50 disposed through the pump 100 from a drive end 105 to an opposing wet end 110. As understood by the skilled artisan, the drive end 105 of the drive shaft 50 is operationally configured to be coupled to a motor via a coupling (not shown) for turning or rotating the drive shaft 50. Turning or rotation of the drive shaft 50 results in turning or rotation of an impeller threadedly connected at the wet end 110 of the pump 100.

Figure 2:
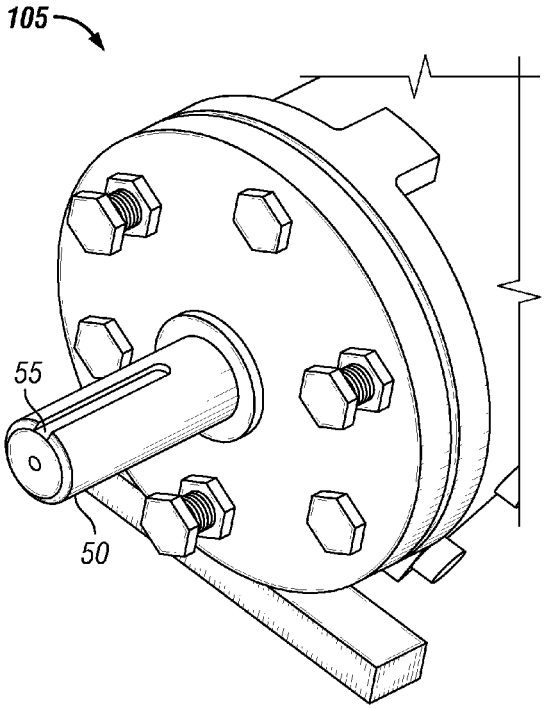
FIG. 2 is a simplified perspective view of the drive end of a drive shaft of a centrifugal pump.

As shown in FIG. 2, a typical drive end 105 of a drive shaft 50 includes a linear recessed portion or "key way" 55 disposed a predetermined length along its surface that is operationally configured to receive at least part of a "drive key" (as the term is understood by persons of ordinary skill in the art) in engagement thereto. In pump operation, a motor coupling attachable to the drive end 105 of a shaft 50 suitably includes a similar key way for receiving at least part of the same drive key in engagement thereto. As understood by the skilled artisan, drive key communication is effective for securing a motor coupling to the drive end 105 of the drive shaft 50 in order to turn or rotate the drive shaft 50. Although pumps may be built to various sizes, for the purpose of this application drive shafts 50 having the following dimensions are common:

- Outer diameter: about 2.22 cm to about 6.03 cm (about 0.875 inches to about 2.375 inches)
- Length: about 2.54 cm to about 3.49 cm (1.0 inches to about 1.375 inches);

with or including a key way 55 having the following dimensions:

- Length: about 2.54 cm to about 3.175 cm (about 1.0 inches to about 1.25 inches);
- Depth: about 0.238 cm to about 0.794 cm (about 0.094 inches to about 0.313 inches);
- Width: about 0.476 cm to about 1.588 cm (about 0.1875 inches to about 0.625 inches).

As such, typical drive keys for use with the present application may have the following dimensions (although any size and shape effective for acting on a drive end 105 of a drive shaft 50 is herein contemplated):

- Length: about 2.54 cm to about 3.175 cm (about 1.0 inches to about 1.25 inches);
- Width: about 0.476 cm to about 1.588 cm (about 0.1875 inches to about 0.625 inches);
- Height: about 0.476 cm to about 1.588 cm (about 0.1875 inches to about 0.625 inches).

Figure 3:
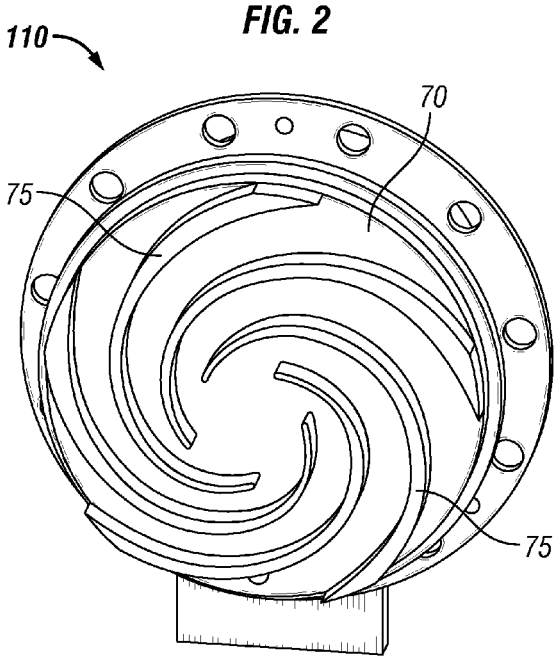
FIG. 3 is a simplified perspective view of an exemplary impeller attached at the wet end of a drive shaft of a centrifugal pump.

With attention to FIG. 3, an exemplary impeller 70 attachable at the wet end 110 of a drive shaft 50 is shown. As understood by the skilled artisan, an end case (not shown) typically covers an impeller 70 at the wet end 110 during pump 100 operation. Removal of an end case suitably exposes the impeller 70 as shown in FIG. 3. As mentioned previously, impellers 70 may be provided with one or more vanes 75 in either a radial configuration or a sloping ("curved") configuration as shown in FIG. 3. Depending on the commercial source, some impellers 70 include an even number of vanes while other impellers 70 include an odd number of vanes (the impeller 70 of FIG. 3 includes five clockwise curving vanes 75). As understood by the skilled artisan, the size, shape and number of vanes of an impeller 70 dictates pressures, discharge capacities and types of material that can pass through a pump. As such, the present approach is effective for allowing persons the ability to remove and install various pump impellers 70 over time in a non-destructive manner.

Up until the time of this application, persons have typically employed instruments such as crow bars and screw drivers to act on impellers 70 to assist with impeller 70 removal and installment, i.e., for acting on the wet end 110 of a pump 100. In one known technique of impeller 70 removal, a person may position and hold the elongated metal end of a screw driver lengthwise between the side walls of vanes 75 in a manner effective to impede impeller 70 rotation. Simultaneously, the same person, or another person, may rotate the drive end 105 of the drive shaft 50 via an instrument such as a wrench, pliers, channel locks, or the like turning the drive end 105 of the drive shaft 50 in a direction to loosen the threaded impeller 70 from the drive shaft 50. Often, the force applied by an instrument such as a screw driver to a particular part or section of one or more impeller vanes 75 causes one or more parts of the vanes 75 to break, deform or otherwise damages the vanes 75 resulting in an unbalanced impeller 70. Likewise, the drive end 105 of the drive shaft 50 may be damaged if contacted violently or too tightly via an instrument thereby deforming or stripping the drive end 105. Damaged impellers are either discarded or repaired in a manner that may diminish the surface area of the impeller, thereby possibly negatively affecting the performance of the impeller during pump operation. Likewise, a damaged drive end 105 may result in replacement of a damaged drive shaft 50 and/or bearings.

Damage to an impeller 70 during removal and reattachment may be prevented or otherwise minimized via a system of tools including a tool that is operationally configured to distribute torque substantially evenly across the surface of an impeller 70 during impeller removal and/or installation. In other words, the present application provides a tool or impeller tool operationally configured to engage one or more impeller vanes 75 and apply force to the side walls of the one or more impeller vanes 75 in a manner effective to evenly distribute force across the impeller 70 when either removing an impeller 70 from a drive shaft 50 or installing an impeller 70 to a drive shaft 50. At a minimum, a suitable tool may include a support member and one or more raised vanes disposed along a surface of the support member, the one or more raised vanes being operationally configured to engage one or more impeller vanes 75 as desired. For example, where a target impeller 70 includes curved vanes the corresponding tool may also include curved raised vanes. In another embodiment, a tool may be provided with radially disposed raised tool vanes for use with an impeller 70 having a radial vane configuration. In one embodiment, a support member may include a planar type surface for providing one or more raised vanes. In another embodiment, a support member may include a non-planar surface for providing one or more raised vanes.

Figure 4:
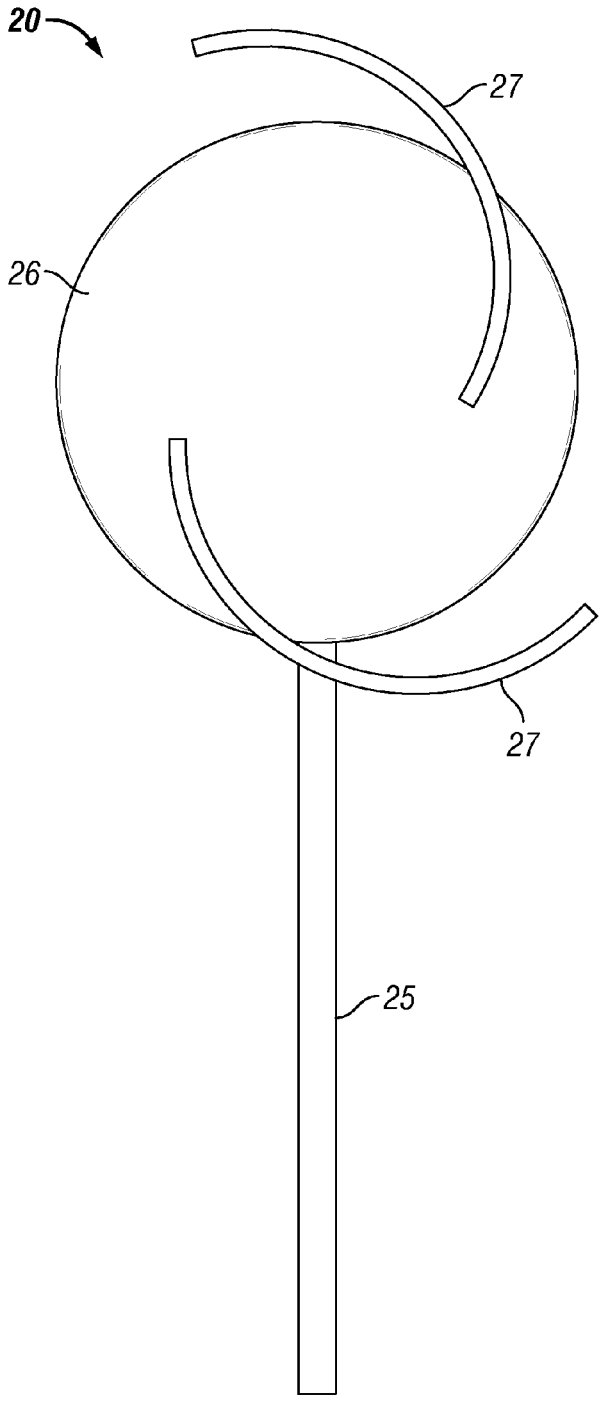
FIG. 4 is a front view of a simplified embodiment of an impeller tool.

FIG. 4 depicts one simplified embodiment of an impeller tool 20 operationally configured to prevent or otherwise minimize impeller damage by distributing torque substantially evenly across the surface of an impeller 70 during impeller removal and/or installation. In this embodiment, the impeller tool 20 includes a support member or impeller face member 26, a handle 25 extending there from the handle 25 being defined by a longitudinal axis as shown. Suitably, the support member or impeller face member 26 has a first support surface and an opposing second surface with one or more raised vanes or tool vanes 27 disposed along the first support surface of the face member 26, the distal ends of the tool vanes 27 extending out beyond the perimeter edge of the face member 26 as shown. In other embodiments, one or more of the tool vanes 27 may be disposed entirely within the outer perimeter of the face member 26. Suitably, the side walls of the raised tool vanes 27 are operationally configured to engage the vanes of an impeller 70.

Figure 5:
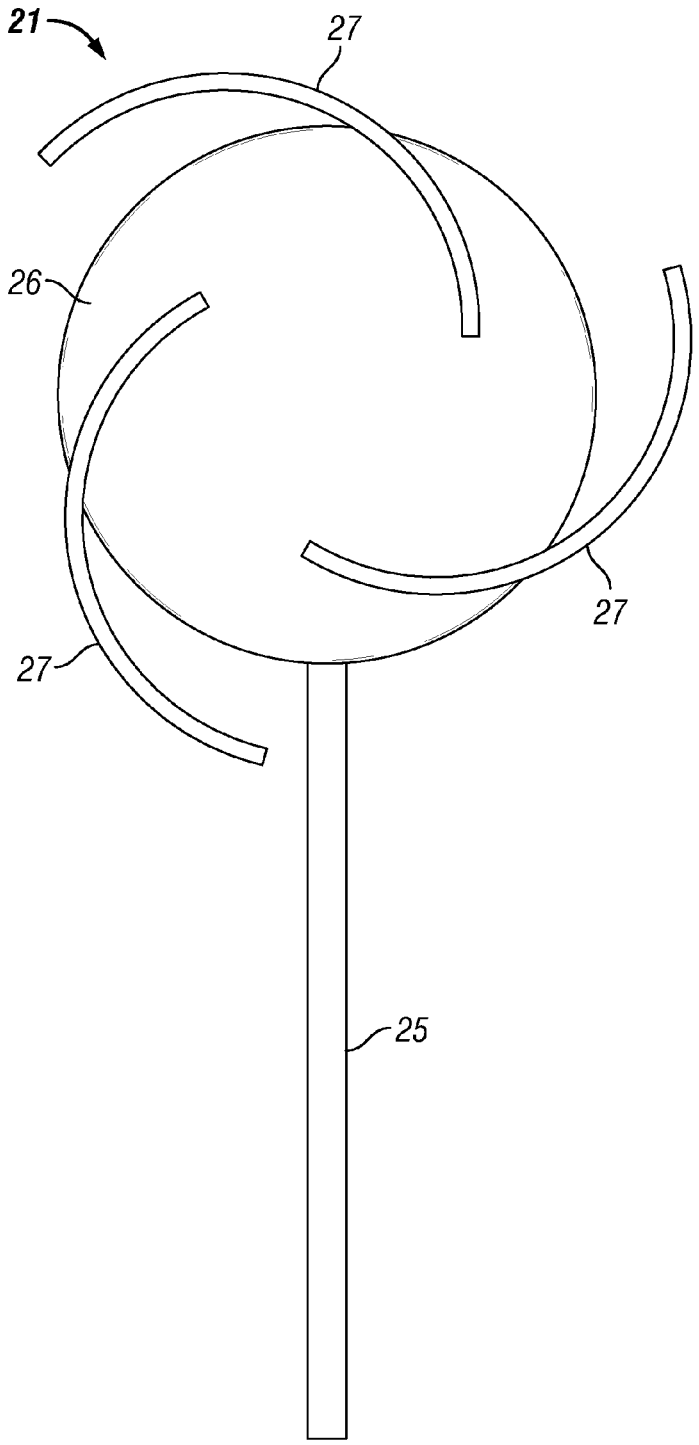
FIG. 5 is a front view of another simplified embodiment of an impeller tool.

The impeller tool 20 of FIG. 4 includes two raised tool vanes 27, i.e., an even number of tool vanes 27. A second impeller tool 21 may also be provided, as depicted in FIG. 5, which includes three tool vanes 27, i.e., an odd number of tool vanes 27. According to impeller design characteristics, impeller tools having an even number of tool vanes 27 are suitably operationally configured for use with impellers 70 having an odd number of impeller vanes 75. Likewise, impeller tools having an odd number of tool vanes 27 are suitably operationally configured for use with impellers 70 having an even number of impeller vanes 75. Hereafter, such grouping may be referred to as an "even/odd vane count relationship." In another embodiment, an impeller tool may be constructed to work with a particular impeller from a particular manufacturer. For example, a commercially available impeller from a particular commercial source may have a particular vane count and vane configuration. As such, a particular impeller tool may be operationally configured for use with a particular commercially available impeller configuration.

Figure 6:
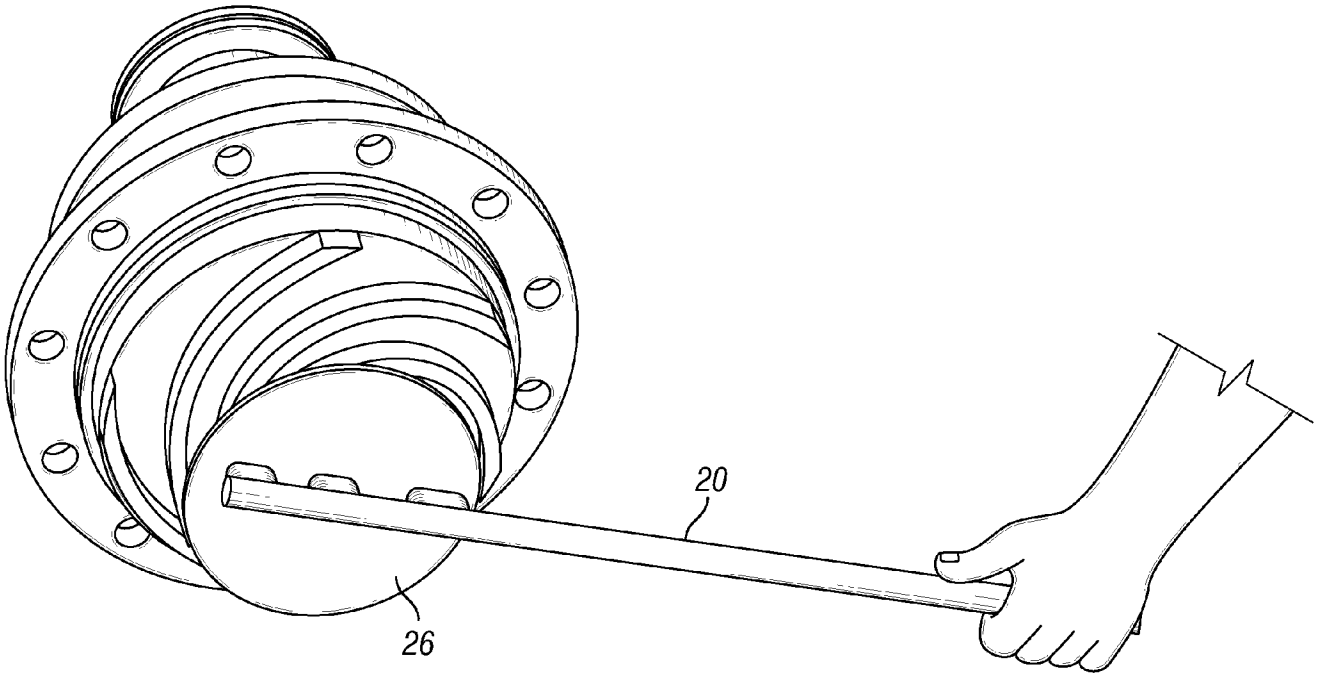
FIG. 6 is a simplified illustration of an impeller tool in an engagement position with an impeller attached at the wet end of a drive shaft of a centrifugal pump.
Figure 7:
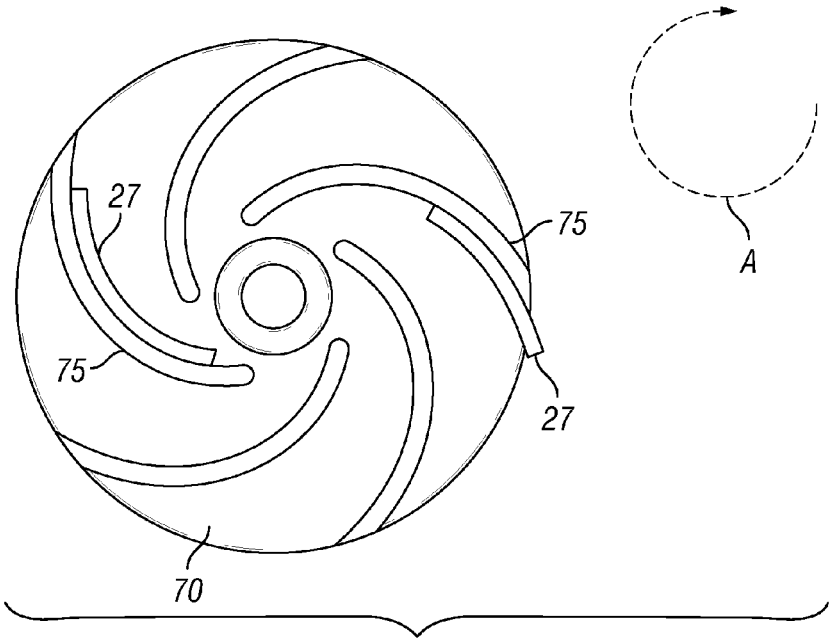
FIG. 7 is an exemplary phantom type view including partial vanes of an impeller tool illustrating communication with the vanes of an impeller during removal of an impeller from a drive shaft of a centrifugal pump.

Turning to the simplified illustrations of FIGS. 6 and 7, when an impeller tool 20 is set to an engagement position with an impeller 70 for impeller removal and/or installation purposes, at least part of the side walls of the tool vanes 27 suitably abut at least part of the side walls of the impeller vanes 75 on a side of the impeller vanes 75 necessary to prevent rotation of the impeller 70 directionally according to directional rotation of the corresponding drive shaft 50 (see directional arrow A in FIG. 7). As stated, the configuration of the tool vanes 27 may be substantially similar to the configuration of the impeller vanes 75 providing for suitable abutment between the surfaces of the tool vanes 27 and the impeller vanes 75 as desired. However, the tool vanes 27 may be shaped differently than the impeller vanes 75 and still substantially evenly distribute torque across the impeller 70 according to points of contact with the vanes 75. For example, in an embodiment including impeller vanes 75 tilted more backward than the impeller vanes 75 as depicted in FIG. 3, the tool vanes 27 may be operationally configured to engage the impeller vanes 75 in a manner effective to prevent rotation of the impeller 70 as described above even where the vanes 27 and 75 are not similarly configured.

As understood by the skilled artisan, the impeller tool 20 may be built to scale. In one embodiment, the impeller face member 26 may have a width or outer diameter greater than the outer diameter of a corresponding impeller 70. In another embodiment, the impeller face member 26 may have a width or outer diameter less than the outer diameter of a corresponding impeller 70. In another embodiment, the impeller face member 26 may have a width or outer diameter about equal to the outer diameter of a corresponding impeller 70. In an embodiment for use with a pump as shown in FIG. 1, a suitable impeller face member 26 may have a width or outer diameter of about 16.51 cm (6.5 inches). Because impeller vanes 75 may include one or more sharp edges, a suitable impeller tool 20 provides a safety feature by allowing an individual to install and remover an impeller 70 without having to physically handle or otherwise touch the impeller vanes 75 with his/her hand(s).

Figure 11:
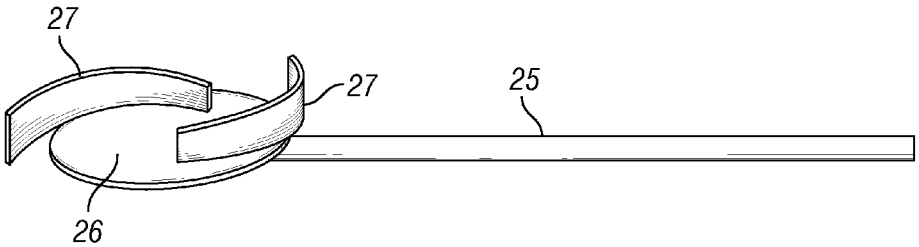
FIG. 11 is a perspective view of another embodiment of an impeller tool of this application.

In one embodiment, the tool vanes 27 may rise out from the impeller face member 26 in a manner effective to maximize surface area abutment between the tool vanes 27 and the impeller vanes 75 for one or more particular impellers 70. In one embodiment, the side walls of the tool vanes 27 may have a height greater than the height of the side walls of corresponding impeller vanes 75. In another embodiment, the side walls of the tool vanes 27 may have a height less than the height of the side walls of corresponding impeller vanes 75. In still another embodiment, the side walls of the tool vanes 27 may have a height about equal to the height of the side walls of corresponding impeller vanes 75. In an embodiment for use with common commercially available pumps, the side walls of the tool vanes 27 may have a constant height of about 2.54 cm (1.00 inches) or more. In one particular embodiment, the side walls of the tool vanes 27 may have a constant height of about 3.175 cm (1.25 inches). In another particular embodiment, the tool vanes 27 may include curved vanes of a non-constant height along the length of one or more of the vanes, e.g., the tool vanes 27 may taper toward the center of the impeller face member 26 at an angle ranging from about ten degrees to about thirty degrees whereby the height of the tool vanes decrease toward the center of the impeller face member 26 as shown in FIG. 11—or vice versa. Depending on the configuration of the impeller 70 being targeted for removal and/or installation, a tool vane 27 configuration as shown in FIG. 11 may maximize the depth of the tool vanes 27 in relation to the impeller vanes 75 during impeller tool 20 operation. As understood by the skilled artisan, an impeller 70 may be shallower near its eye than near its perimeter. As such, the tool vane 27 configuration as shown in FIG. 11 may decrease the distance between the impeller face member 26 and the impeller vanes 75 during impeller tool 20 operation. In still another implementation, the tool vanes 27 may taper outward to the perimeter of the impeller face member 26.

Suitably, the handle 25 of an impeller tool 20, 21 may be operationally configured to (1) be hand held and (2) apply specific torque to a target impeller 70. As shown in FIGS. 4-6, a suitable handle 25 may be similar in design to handles found on a variety of known torquing tools. Although the handle 25 may be constructed as desired, for a majority of tasks contemplated herein, one suitable handle may be cylindrical in shape including the following dimensions:

Length: about 50.8 cm to about 60.96 cm (20.0 inches to about 24.0 inches);

Diameter: about 1.91 cm to about 2.54 cm (0.75 inches to about 1.0 inches).

Multi-sided handles 25 are also contemplated. Also, one or more grip materials may be applied to the surface of a handle 25 as desired, e.g., a rubber, plastic, leather, and combination thereof. In another embodiment, the surface of a handle 25 may incorporate knurling as the term is understood by the skilled artisan. In one embodiment, the impeller tool 20, 21 may include a one piece construction, e.g., via mold casting or machining. In another embodiment, various parts of the impeller 20, 21 may be assembled as desired, e.g., adhesives, fasteners, welds, threads, male/female connections, joint connections, and combinations thereof.

The impeller tool 20, 21 may include a one piece handle 25 as shown in FIGS. 4-6. In other embodiments, handles 25 may be adjustable. For example, a handle 25 may include a telescoping member. In another embodiment, a handle 25 may be foldable. In another embodiment, a handle 25 may be disassembled into two or more separate parts. It is also contemplated that handle size, weight and shape may be altered as understood by the skilled artisan familiar with hand tool ergonomics, e.g., tapered width handles, curved handles, bent or angled handles, weighted handles, weight balanced handles. In one particular embodiment, the second surface of an impeller face member 26 may include a recessed surface meant to be hand held and/or held by a torqueing tool. The second surface of an impeller face member 26 may also include a knob type member or strap for hand holding purposes. In another embodiment, the second surface of an impeller face member 26 may include a hand pressing type member. In still another embodiment, the impeller tool of this application may include a male or female mating surface disposed along the second surface of an impeller face member 26 for receiving a torqueing tool, e.g., a ratchet effective to apply specific torque to a target impeller 70. In still another embodiment, the perimeter of the support member, for example, the perimeter of the impeller face member 26 may itself be hand held. The second surface of an impeller face member 26 may also include one or more finger indentations or cavities.

A suitable impeller tool 20 may be constructed from one or more materials providing operative structural support in connection with impeller removal and/or installation. In one implementation, a suitable impeller tool 20 may be constructed from one or more like material(s) of construction as a target impeller 70. In another implementation, a suitable impeller tool 20 may be constructed from one or more materials different from a target impeller 70. One suitable impeller tool 20 may be constructed from one or more materials including, but not necessarily limited to, those materials resistant to chipping, cracking, excessive bending and reshaping as a result of weathering, heat, moisture, other outside mechanical and chemical influences, as well as impacts and forces applied to the impeller tool 20. Particular materials of construction may include, but are not necessarily limited to metals, plastics, rubbers, cementitious materials, woods, filled composite materials, and combinations thereof. Suitable metals include ferrous metals and non-ferrous metals. A suitable ferrous metal may include an iron alloy, for example, steel. In addition, one or more of the parts of the impeller tool 20, e.g., the handle 25, the impeller face member 26 and the tool vanes 27 may be constructed from one or more materials different from the other parts of the impeller tool 20. An impeller tool 20 may also include one or more outer protective layers as desired. Suitable protective layers may be constructed from materials including, but not necessarily limited to rubber, plastic, and combinations thereof.

Figure 8:
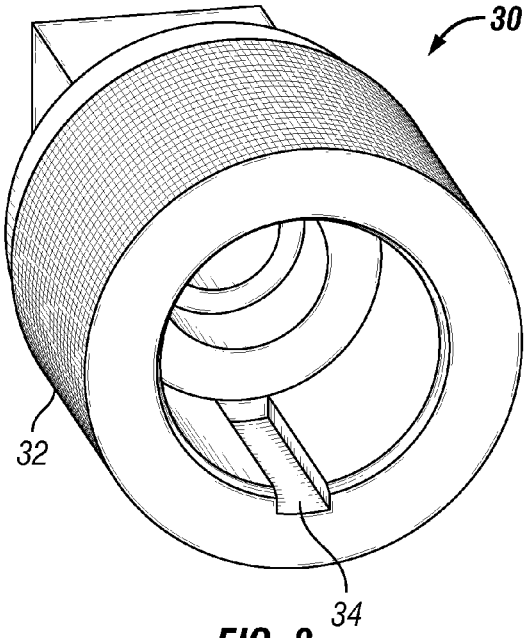
FIG. 8 is a perspective view of an exemplary shaft socket of this application.
Figure 9:
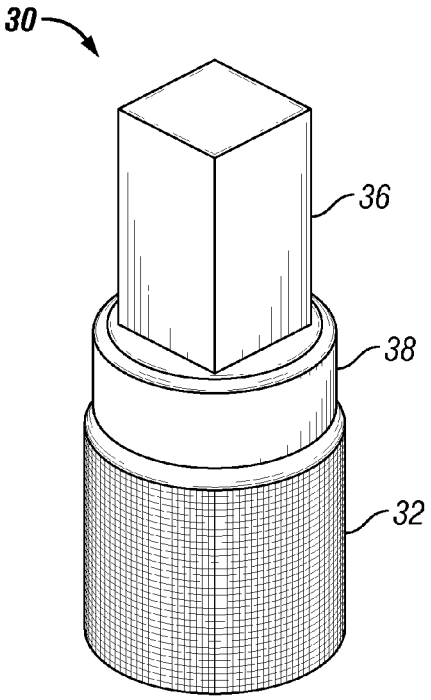
FIG. 9 is another perspective view of the shaft socket of FIG. 8.

With attention now to FIGS. 8 and 9, one suitable socket member or shaft socket 30 operationally configured to communicate and act on the drive end 105 of a pump 100 is shown. Suitably, the shaft socket 30 may be mated to a drive end 105 of a drive shaft 50 in a manner effective to provide a contact surface for turning the shaft socket 30 and the drive shaft 50 in communication thereto without damaging the drive shaft 50. One suitable shaft socket 30 may include a female type mating surface at a female type receiving end 32 defined by a key way 34 disposed along the inner surface of the receiving end 32 that is operationally configured to receive at least part of a drive key for communicating with the key way 55 of a drive end 105 of a drive shaft 50. As shown in the embodiment of FIG. 9, a shaft socket 30 may include a male type mating surface or male type drive end 36 operationally configured to provide a contact surface for manipulating the shaft socket 30 in a manner effective to turn the drive shaft 50 in communication thereto. As understood by persons of ordinary skill in the art, the male type drive end 36 suitably includes a contact surface configuration for one or more torqueing tools including, but not necessarily limited to pliers, wrenches, torque multipliers, ratchets, breaker bars, pneumatic torque multipliers, crescent hand tools, and combinations thereof. Suitable wrenches may include, but are not necessarily limited to adjustable wrenches, chain wrenches, box end wrenches, check nut wrenches, open end wrenches, hydraulic wrenches, and other hand held wrenches. With attention to the embodiment of FIG. 10, another shaft socket 30 may include a female type drive end 37 operationally configured to provide a contact surface for manipulating the shaft socket 30 in a manner effective to rotate the drive shaft 50 in communication thereto, e.g., via a ratchet, a power tool, or the like. In another embodiment, the shaft socket 30 may include a hand gripping member or handle for manual operation of the shaft socket 30. In still another embodiment, a shaft socket may be provided without a drive end 36, whereby the outer surface of the receiving end 32 may provide a contact surface of the shaft socket 30.

Figure 10:
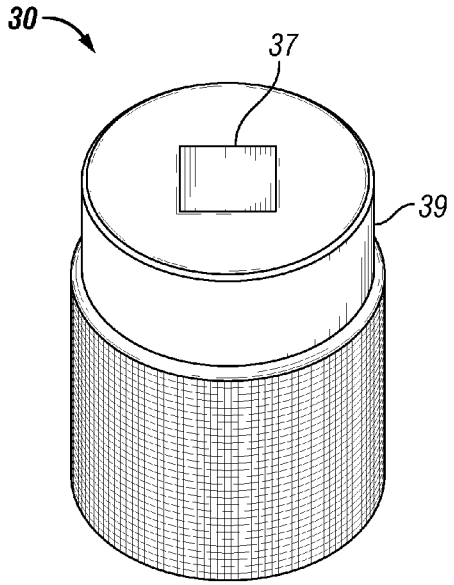
FIG. 10 is a perspective view of another embodiment of a shaft socket of this application.

The outer surface of the receiving end 32 may include one or more surface configurations as desired. For example, in one embodiment the receiving end 32 may incorporate knurling as shown in FIGS. 8-10. In addition, a shaft socket 30 may include an intermediate section 38 operationally configured to separate the female type receiving end 32 from the male type drive end 36. With particular attention to FIG. 9, an intermediate section 38 may also provide a surface for displaying information including, but not necessarily limited to shaft socket product information, the identity of the manufacturer, distributor, wholesaler, etc., one or more trademarks, patent related information, and combinations thereof. Information may be applied to an intermediate section 38 via machining, silk screening, ink, paint, adhesive labels, decals, stickers and the like, and combinations thereof. In the embodiment as shown in FIG. 10, the shaft socket 30 may also include an intermediate surface 39 operationally configured to provide a surface for displaying information as described above.

As shown, one suitable shaft socket 30 may include a one piece construction, e.g., via mold casting or machining, although multiple part shaft sockets are herein contemplated. Without limiting the invention, a suitable shaft socket 30 may be constructed from one or more materials providing operative structural support in connection with impeller 70 removal and/or installation. In one implementation, a suitable shaft socket 30 may be constructed from one or more like material(s) of construction as a target drive shaft 50. In another implementation, a suitable shaft socket 30 may be constructed from one or more materials different from a target drive shaft 50. One suitable shaft socket 30 may be constructed from one or more materials including, but not necessarily limited to, those materials resistant to chipping, cracking, excessive bending and reshaping as a result of weathering, heat, moisture, other outside mechanical and chemical influences, as well as impacts and forces applied to the shaft socket 30. Particular materials of construction may include, but are not necessarily limited to metals, plastics, rubbers, cementitious materials, woods, filled composite materials, and combinations thereof. Suitable metals include ferrous metals and non-ferrous metals. A suitable ferrous metal may include an iron alloy, for example, steel.

It is believed that the approach of the present invention and many of its attendant advantages will be understood by the foregoing description. It is also believed that it will be apparent that various changes may be made in the form, construction and arrangement of the components thereof without departing from the scope and spirit of the invention or without sacrificing all the material advantages. The form herein before described being merely exemplary and explanatory embodiments thereof. The following paragraphs may encompass and include such changes.

A system for acting on the wet end and drive end of a pump shaft simultaneously to promote engagement and/or disengagement of an impeller, the system including (1) a first tool member operationally configured to communicate with the drive end shaft; and (2) a second. member operationally configured to communicate with an impeller attachable at the wet end of the shaft, the second member being effective to distribute torque substantially evenly across the surface of an impeller during engagement and/or disengagement of the impeller.

A system for the assembly and disassembly of a pump including (1) a first member releasably attachable to the drive end of a drive shaft of a pump, the first member being operationally configured to turn the drive shaft; (2) and a second member operationally configured to engage an impeller in a manner effective to distribute torque substantially evenly across an impeller up to 360.0 degrees about an eye of the impeller when removing and installing an impeller.

A removal and installation system for a pump impeller, including (1) a tool operationally configured to engage one or more of the vanes of an impeller; (2) a socket releasably attachable to a drive end of a drive shaft of a pump; and (3) a torquing tool for acting on the socket to turn the drive shaft.

A method for maintaining the integrity of an impeller and a drive shaft of a pump during impeller removal and installation, the method comprising the following steps (A) providing (1) a impeller tool operationally configured to apply torque substantially evenly along the vanes of an impeller threadedly connected to the drive shaft, (2) a socket for mating with a drive end of the drive shaft in a manner effective to maintain the socket in fixed position relative to the drive end of the drive shaft; (B) mating the socket with the drive end and engaging the impeller with the tool; and (C) using a torqueing tool, rotating the socket and drive shaft as the impeller tool holds the impeller in a non-rotating position.

A removal and installation system for a pump impeller, including (1) an impeller engagement device operationally configured to engage one or more of the vanes of an impeller; (2) a socket releasably attachable to a drive end of a drive shaft of a pump; (3) a torqueing tool for acting on the impeller engagement device; and (4) a torqueing tool for acting on the socket to rotate the drive shaft.

A removal and installation system for a pump impeller, including (1) a set of a plurality of impeller took operationally configured for use with a plurality of pump impellers of various vane counts and various sizes and (2) a set of a plurality of sockets operationally configured for use with various sizes of pump drive shafts.

A tool for engaging a vaned impeller, the tool including an engagement surface defined by vanes operationally configured to distribute torque substantially evenly across the impeller, the vanes of the tool and the impeller being in an even/odd vane count relationship. The tool may include a handle to assist with manually holding an impeller in a fixed position as a drive shaft to which the impeller is connected is rotated.

Reference is made to the following non-limiting example, which is illustrative only and not intended to limit the present invention to a particular embodiment.

EXAMPLE 1

With attention to the impeller tool of FIG. 11, the curved raised vanes include a non-constant height along the length of the vanes 27 and thickness as follows:

Height near the center of the impeller face member 26: about 2.22 cm (0.875 inches);

Height near the outer perimeter of the impeller face member 26: about 2.86 cm (1.125 inches);

Thickness of the vanes 27: about 0.64 cm (0.25 inches). The vanes 27 taper outward in height at about a twenty degree angle.

Persons of ordinary skill in the art will recognize that many modifications may be made to the present application without departing from the spirit and scope of the application. The embodiment(s) described herein are meant to be illustrative only and should not be taken as limiting the invention, which is defined in the claims.

The invention claimed is:

1. A system for acting on a wet end and a drive end of a pump drive shaft to promote engagement and disengagement of a vaned pump impeller to and from the pump drive shaft, the system including:

a first tool member operationally configured to communicate with the drive end of the pump drive shaft;

and a second tool member for communicating with a vaned pump impeller attachable at the wet end of the pump drive shaft, the second tool member including a face member with a first support surface and an opposing second surface, the face member having (1) a perimeter edge defining the perimeter of the first support surface and the opposing second surface and (2) one or more raised vanes disposed along the first support surface, wherein the one or more raised vanes are each defined by a distal end terminating at a location different than the perimeter edge of the face member.

2. The system of claim 1 wherein the first tool member includes a socket member with a female mating surface defined by a key way.

3. The system of claim 1 wherein the one or more raised vanes include side walls.

4. The system of claim 3 wherein the first tool member includes a socket member with a female mating surface defined by a key way.

5. The system of claim 4 wherein the socket member includes a male type mating surface operationally configured to provide a contact surface for manipulating the socket member.

6. The system of claim 5 wherein the male type mating surface includes a contact surface configuration for one or more torqueing tools selected from the group consisting of pliers, wrenches, torque multipliers, ratchets, breaker bars, pneumatic torque multipliers, crescent hand tools, and combinations thereof.

7. The system of claim 3 wherein the side walls are operationally configured to engage one or more vaned pump impeller vanes.

8. The system of claim 3 wherein the one or more raised vanes are curved and have a non-constant height along the length of the one or more raised vanes relative to the first support surface.

9. The system of claim 3 whereby, when the second tool member is in operable communication with the vaned pump impeller, the location of the face member in relation to the vaned pump impeller is determined according to the height of the one or more raised vanes disposed along the first support surface.

10. The system of claim 1 wherein the second tool member includes a handle extending from said second surface.

11. The system of claim 1 further including a torqueing tool for acting on the first tool member to turn the drive shaft.

12. The system of claim 1 whereby the vaned pump impeller has an outer diameter and the face member has an outer diameter less than the outer diameter of the vaned pump impeller to which the second tool member is communicated.

13. The system of claim 1 wherein the one or more raised vanes are each defined by a distal end terminating at a location out beyond said perimeter edge.

14. A tool set for the assembly and disassembly of a centrifugal pump including the removal and installation of a centrifugal pump impeller having a particular vane count including:

a first tool member releasably attachable to a drive end of a drive shaft of the pump, the first member being operationally configured to act on the drive shaft;

and a second tool member including a face member with a first support surface and an opposing second surface, the face member having (1) a perimeter edge defining the perimeter of the first support surface and the opposing second surface and (2) one or more raised vanes disposed along the first support surface, wherein the one or more raised vanes are each defined by a distal end terminating at a location out beyond said perimeter edge, the second tool member being operationally configured to engage a vaned impeller of the pump.

15. The tool set of claim 14 wherein the one or more raised vanes include side walls operationally configured to engage vanes of the pump impeller.

16. The tool set of claim 14 wherein the second tool member includes an even/odd vane count relationship with the vaned impeller.

17. The tool set of claim 16 wherein the first tool member includes a contact surface configuration for manipulating the first tool member in a manner effective to turn the drive shaft.

18. A method of altering an engagement position of a vaned centrifugal pump impeller in relation to a pump drive shaft, including:

providing a tool set including (A) a first tool member operationally configured to communicate with a drive end of the pump drive shaft; and (B) a second tool member for communicating with a vaned pump impeller attachable at a wet end of the pump drive shaft, the second tool member including a face member having a first support surface and an opposing second surface, the face member having (1) a perimeter edge defining the perimeter of the first support surface and the opposing second surface and (2) one or more raised vanes disposed along the first support surface, wherein the one or more raised vanes are each defined by a distal end terminating at a location different than the perimeter edge of the face member, the second tool member being operationally configured to contact the pump impeller at various points during manipulation, engagement and disengagement of the pump impeller;

with the impeller of the centrifugal pump in an exposed position and in communication with the pump drive shaft at a first engagement position, mating a first tool member with the drive end of the pump drive shaft and mating a second tool member with the vaned centrifugal pump impeller; and with the first and second tool members set at fixed mated positions, manipulating the first tool member in a manner effective to turn the pump drive shaft and alter the engagement position of the second mating tool from said first engagement position.

19. The method of claim 18 wherein prior to the providing of said tool set, the vane count of said vaned centrifugal pump impeller is determined.

* * * * *